US007525506B2

(12) United States Patent
Wu et al.

(10) Patent No.: US 7,525,506 B2
(45) Date of Patent: Apr. 28, 2009

(54) ANTENNA APPARATUS AND ANTENNA RADOME AND DESIGN METHOD THEREOF

(75) Inventors: Chun Yih Wu, Taichung (TW); Shih Huang Yeh, Yunlin County (TW); Ken Huang Lin, Kaohsiung (TW); Hsin Lung Su, Kaohsiung (TW); Chih Yung Lo, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 141 days.

(21) Appl. No.: 11/767,685

(22) Filed: Jun. 25, 2007

(65) Prior Publication Data

US 2008/0316140 A1 Dec. 25, 2008

(51) Int. Cl.
*H01Q 1/42* (2006.01)

(52) U.S. Cl. ..... 343/872; 343/909

(58) Field of Classification Search ..... 343/872, 343/909, 910, 700 MS

See application file for complete search history.

(56) References Cited

U.S. PATENT DOCUMENTS 5,140,338 A * 8/1992 Schmier et al. ..... 343/909
5,311,202 A 5/1994 Popp et al.
6,476,771 B1 * 11/2002 McKinzie, III ..... 343/756
6,995,733 B2 2/2006 Waltho
2007/0252775 A1 * 11/2007 Munk et al. ..... 343/872

OTHER PUBLICATIONS

Stefan Enoch et al., A Metamaterial for Directive Emission, Journal, Nov. 18, 2002, vol. 89 No. 21, The American Physical Society.

Li B et al., Study On High Gain Circular Waveguide Array Antenna With Metamaterial Structure, Journal, 2003, pp. 207-219, Nation Key Laboratory of Antennas and Microwave Technology, Xidian University.

* cited by examiner

*Primary Examiner*—Hoang V Nguyen
(74) *Attorney, Agent, or Firm*—WPAT, P.C.; Anthony King

(57) ABSTRACT

An antenna radome is associated with an antenna and comprises a plurality of radome elements arranged in an array. Each radome element comprises a dielectric substrate on which an upper surface is provided with a first fractal inductor layout and a lower surface is provided with a second fractal inductor layout. The second fractal inductor layout comprises a first inductor and a second inductor. The first inductor and second inductor are associated to accumulate charges so as to increase radiation directionality of the antenna.

47 Claims, 10 Drawing Sheets

ANTENNA APPARATUS AND ANTENNA RADOME AND DESIGN METHOD THEREOF

BACKGROUND OF THE INVENTION (A) Field of the Invention

The present invention is related to an antenna apparatus and an antenna radome thereof and the related design method.

(B) Description of the Related Art

An antenna is essential for wireless communication systems, and affects signal quality of the entire system. The strength of a received signal is determined by the following equation:

$$P_L \propto P_t \cdot G_t \cdot G_L$$

where $P_L$ is receiving power at a receiving end, $P_t$ is transmitting power at an emitting end, $G_t$ is antenna gain of a transmitting antenna, and $G_L$ is antenna gain of a receiving antenna.

Accordingly, a design with an antenna of high gain (larger $G_t$ or $G_L$) will enhance signal quality of the wireless communication system (larger receiving power $P_L$). Currently, a method for increasing antenna gain uses an antenna array in which the number of antenna elements is increased to improve the directionality, i.e., increasing the antenna gain. However, the above technique may incur problems of large loss of feeding signals and large volume of the entire antenna unit. Such tradeoffs would limit the increase of antenna gain, and large antennas are not suitable for small apparatuses.

In "Physical Review Letter" of November, 2002, Stefan Enoch disclosed an article titled "A Metamaterial for Directive Emission," through which antenna gain can be increased significantly. A multi-layer square metal grid structure is positioned far from a dipole antenna, allowing the gain of the antenna to be increased to around 10 dB. However, the structure can only be disposed far from the dipole antenna, so its commercialization is not valuable.

SUMMARY OF THE INVENTION

The present invention provides an antenna apparatus including an antenna radome associated with an antenna and the related design method, with a view to increasing radiation directionality of the antenna, i.e., increasing the gain of the antenna. The antenna radome of the present invention is suitable for small size applications with minor return loss of transmission signals.

The antenna apparatus of the present invention comprises an antenna and an antenna radome. The antenna radome is associated with an antenna for signal transmission. The antenna radome comprises a plurality of radome elements. Each radome element comprises a dielectric substrate on which an upper surface is provided with a first fractal inductor layout and a lower surface is provided with a second fractal inductor layout, and the second fractal inductor layout comprises a first inductor and a second inductor. The first inductor and second inductor are associated to accumulate charges so as to increase radiation directionality of the antenna.

As to the design of the antenna radome associated with an antenna of the present invention, a dielectric substrate is provided first, and then fractal inductor layouts are formed on upper and lower surfaces of the dielectric substrate to adjust permittivity and permeability of the antenna, so as to obtain an effective refraction index between 0 and 1.

DETAILED DESCRIPTION OF THE INVENTION

The present invention will be explained with the appended drawings to clearly disclose the technical characteristics of the present invention.

Figure 1:
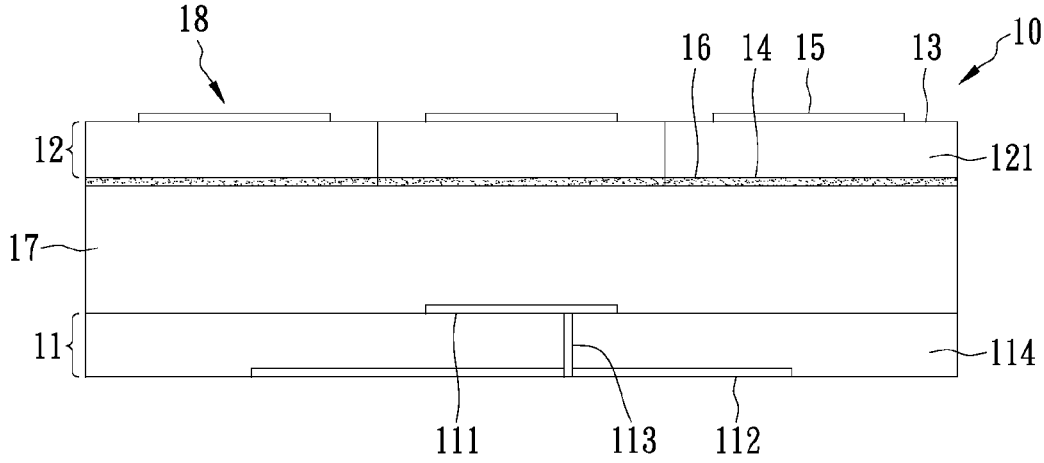
FIG. 1 shows an antenna apparatus in accordance with an embodiment of the present invention.
Figure 2:
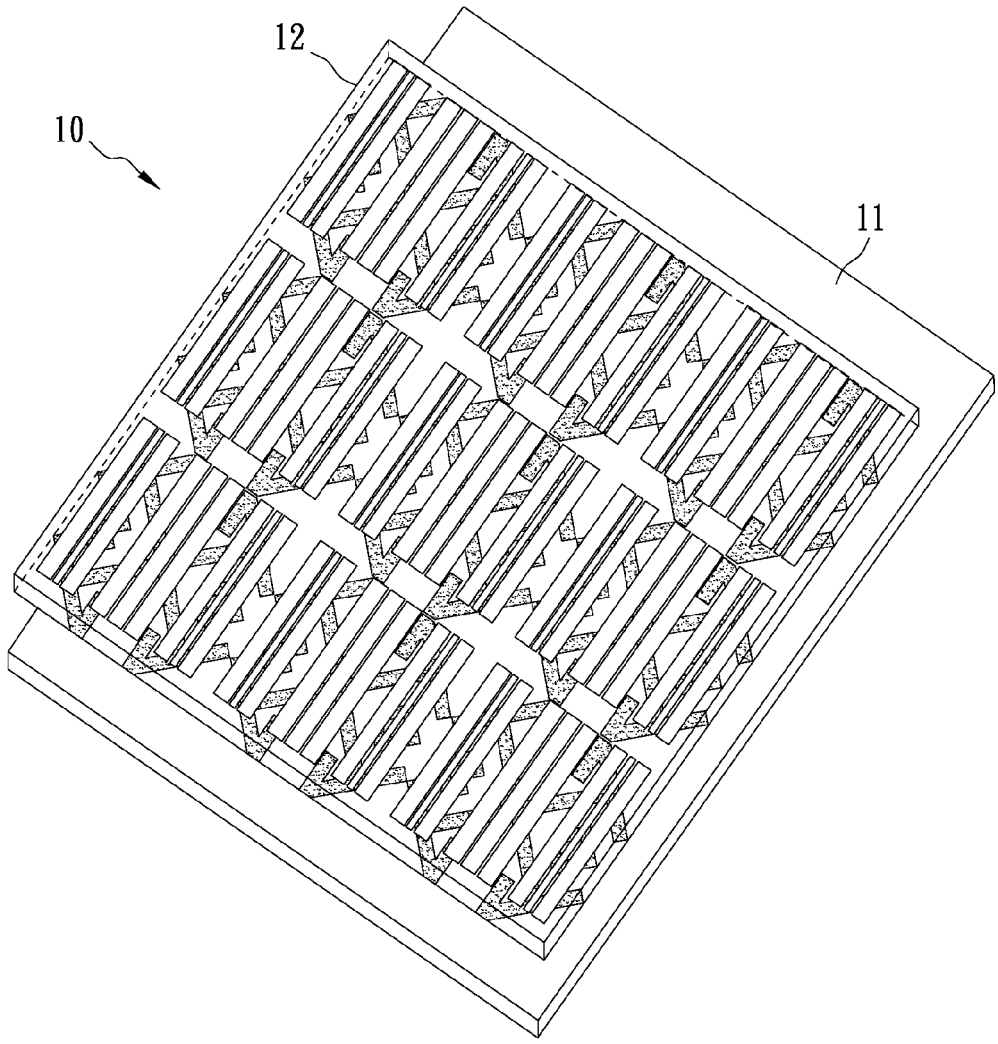
FIG. 2 shows a 3-D view of the antenna apparatus.

FIG. 1 shows an antenna apparatus 10 in accordance with an embodiment of the present invention, and FIG. 2 shows a 3-D view of the antenna apparatus 10. The antenna apparatus 10 includes an antenna 11 and an antenna radome 12 that is placed above the antenna 11. The antenna 11 includes a dielectric device 114 on which a radiation patch 111 and a metal ground surface 112 are provided. An antenna signal feeding member 113 is connected or not connected between the radiation patch 111 and the metal ground member 112. The antenna radome 12 includes a dielectric substrate 121 on which first fractal inductor layouts 15 are formed on an upper surface 13 and second fractal inductor layouts 16 are formed on a lower surface 14 of the dielectric substrate 121. The antenna 11 and the antenna radome 12 have a gap 17 with air therebetween. Preferably, the antenna radome 12 is at a distance less than half-wavelength of an antenna's transmission signal from the antenna 11. Each first fractal inductor layout 15, the corresponding second fractal inductor layout 16 and the dielectric layer 121 therebetween form a radome element 18. In this embodiment, there are nine radome elements 18 arranged in a 3×3 array.

Figure 3:
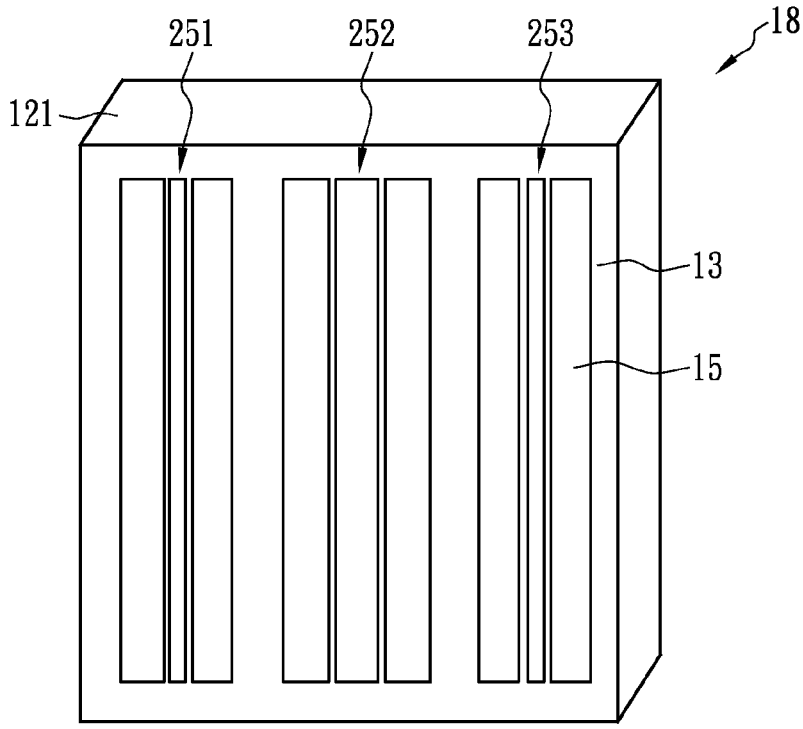
FIGS. 3, 4 and 5 show a radome element in accordance with an embodiment of the antenna apparatus.
Figure 4:
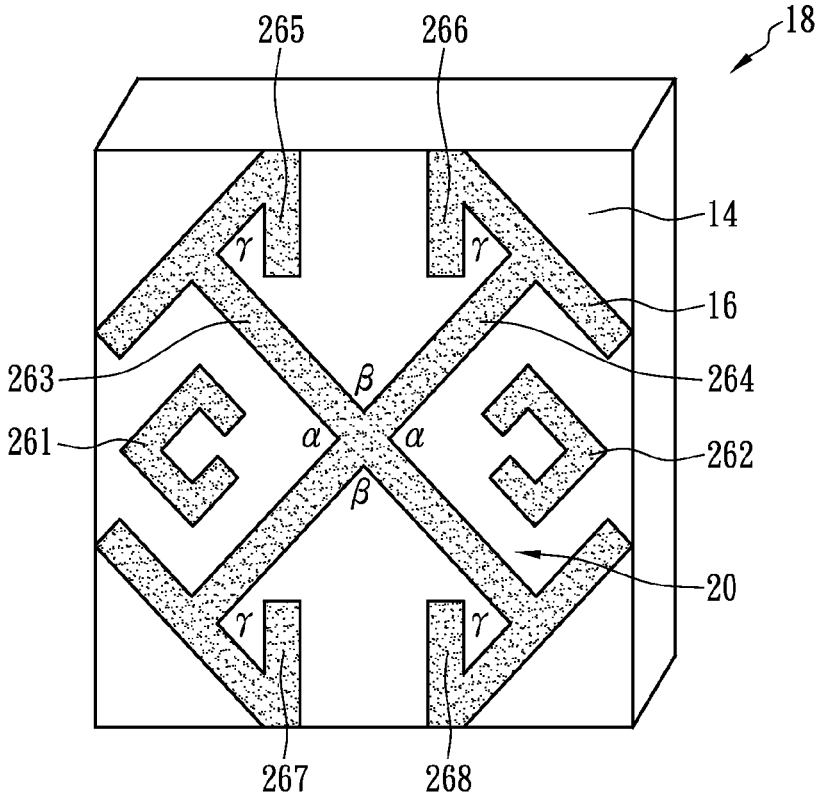
Figure 5:
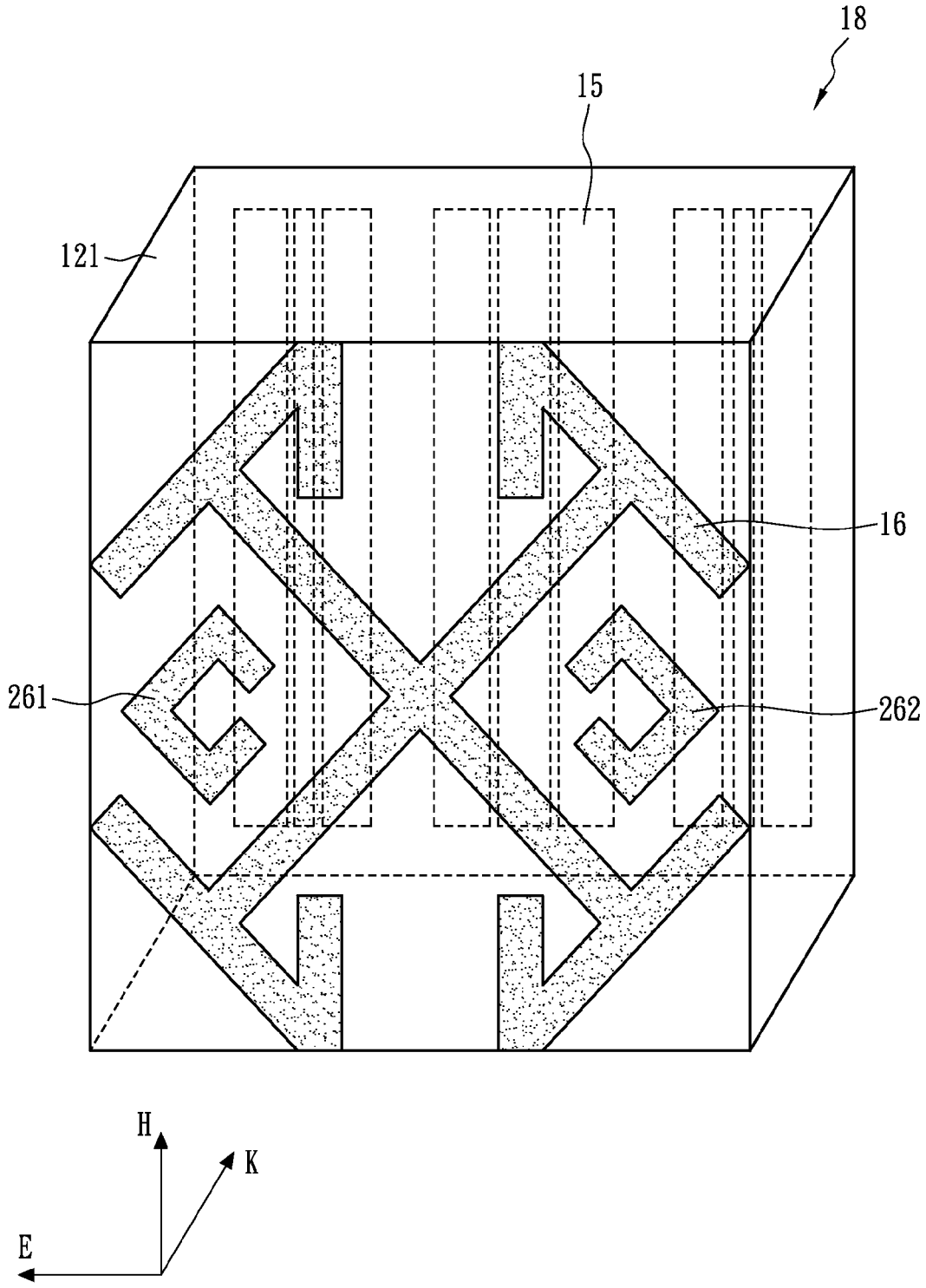
Figure 6A:
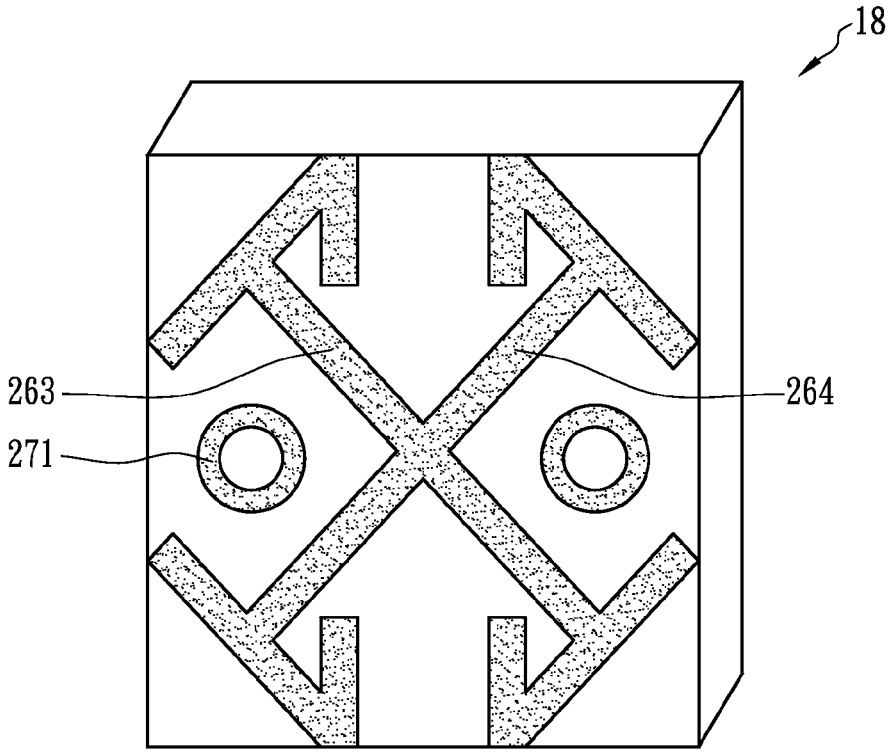
FIGS. 6(*a*) through 6(*e*) show radome elements in accordance with other embodiments of the present invention.
Figure 6B:
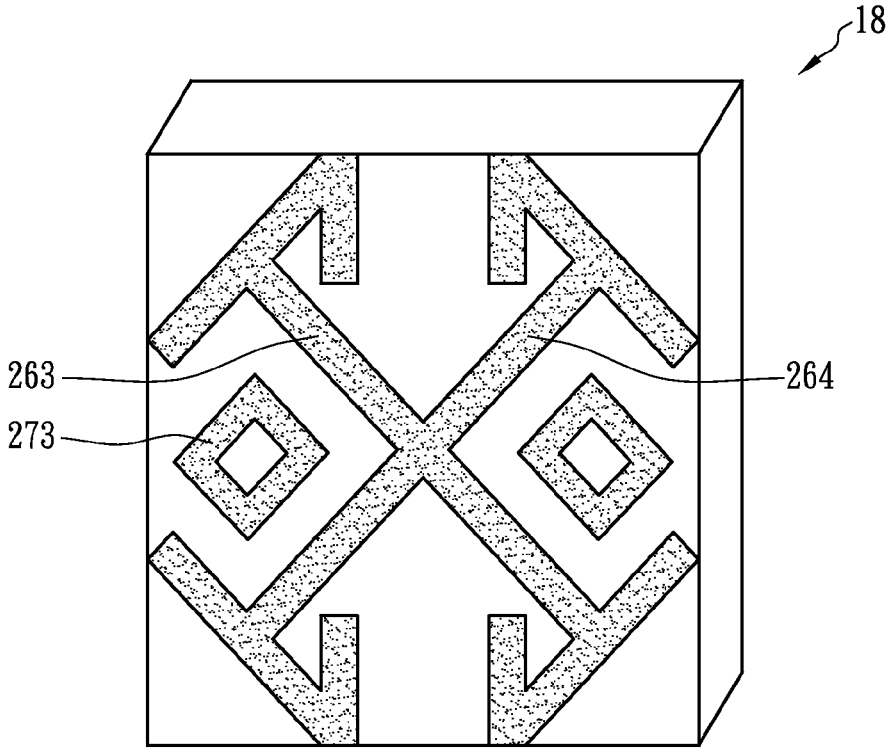
Figure 6C:
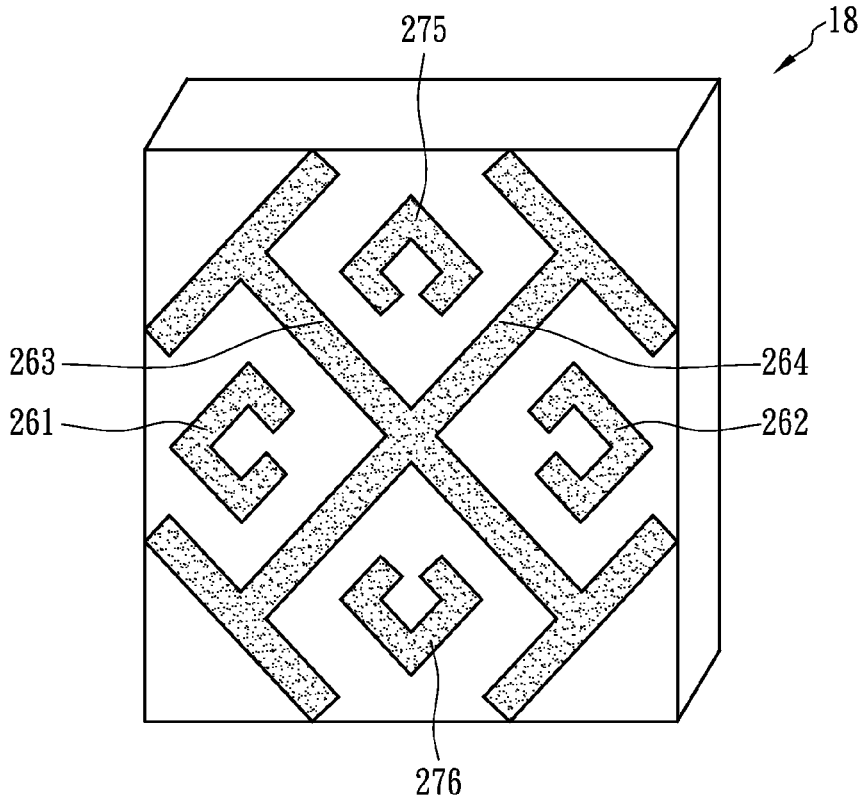
Figure 6D:
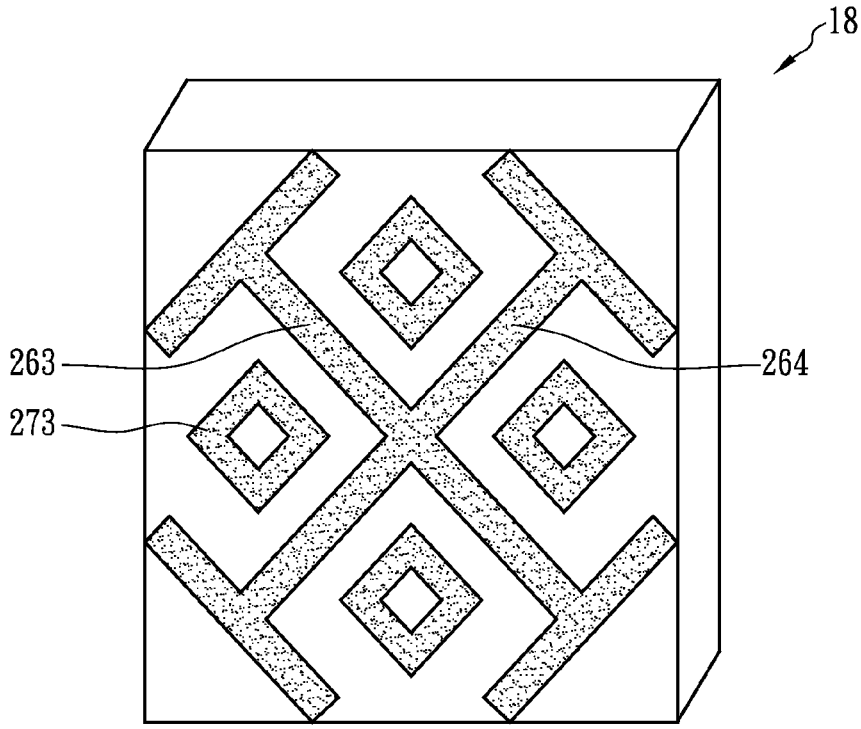
Figure 6E:
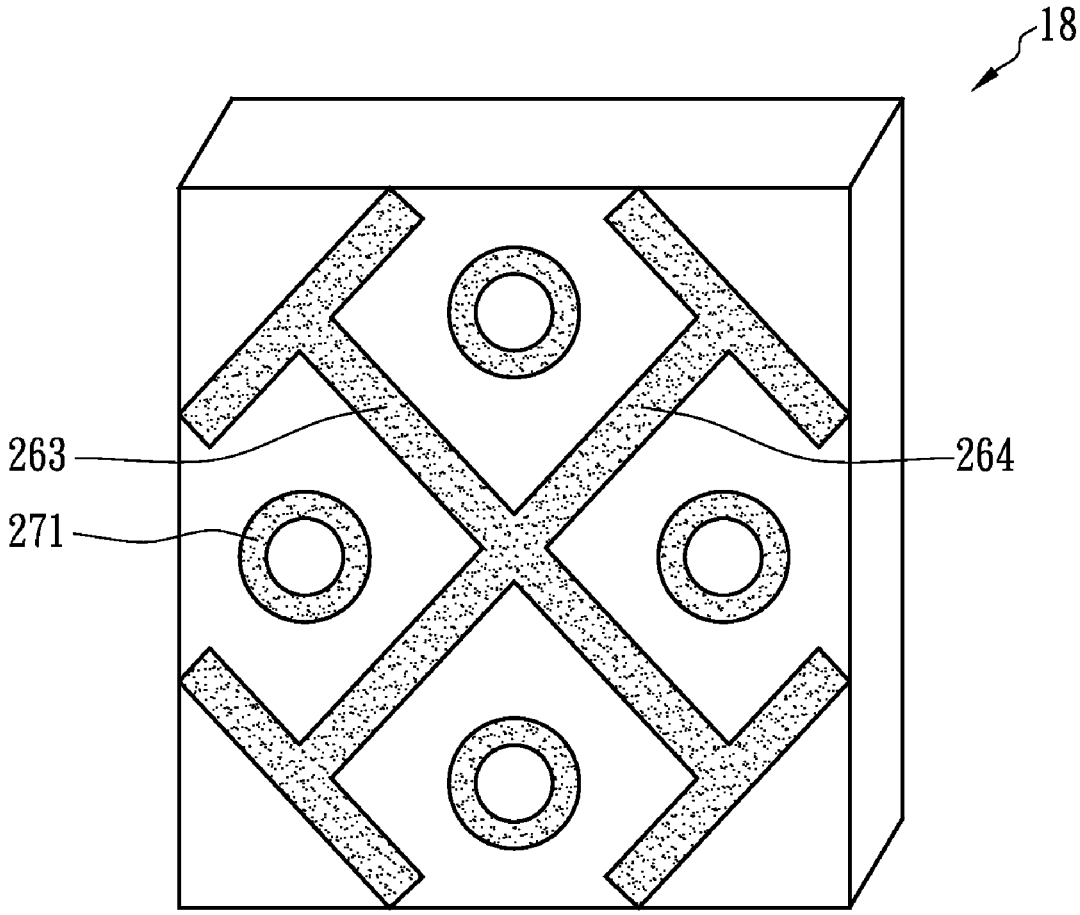

FIGS. 3, 4 and 5 show an embodiment of the radome element 18. As shown in FIG. 3, the first fractal inductor layout 15 on the upper surface 13 of the antenna radome 12 includes a left rectangle inductor group 251, a middle rectangle inductor group 252 and a right rectangle inductor group 253. The rectangle inductor groups 251, 252 and 253 can be of equivalent length and width and each includes three rectangle inductors. In this embodiment, the first fractal inductor layout 15 is configured to decrease the frequency of the antenna 11 from 7 GHz to 5.15-5.35 GHz in order to comply with wireless communications protocol.

As shown in FIG. 4, the second fractal inductor layout 16 includes a first inductor and a second inductor. The first inductor includes a first C-shaped inductor member 261 and a second C-shaped inductor member 262. The second inductor includes a first I-shaped inductor member 263 and a second I-shaped inductor member 264. The first and second inductors can be formed by print technology. The first I-shaped inductor member 263 and the second I-shaped inductor member 264 intersect at angles $\alpha$ and $\beta$ as an X-shaped structure 20. The C-shaped inductor members 261 and 262 are located in two quadrants separated by the two I-shaped inductor members 263 and 264. Inductor members 265, 266, 267 and 268 are connected to ends of the I-shaped inductor member 263 and 264 at angles γ. The opening of the C-shaped inductor member 261 faces the intersection of the X-shaped structure 20, and the opening of the C-shaped inductor member 262 faces the intersection of the X-shaped structure 20 also. The angles α and β are between 45 and 90 degrees, and the angle γ is between 15 and 90 degrees.

As shown in FIG. 5, the directions of the openings of the C-shaped inductor members 261 and 262 are parallel to electric direction E of the antenna 11. Accordingly, more charges can be accumulated; thus radiation directionality of the antenna 11 can be increased. In this embodiment, the radome elements 18 are placed in a 3×3 array to form an antenna radome which can double the gain of the antenna within frequencies of 5.15-5.35 GHz for wireless transmission.

Theoretically, an effective refractive index is equal to the square root of the product of the permittivity and the permeability, i.e., $n_{eff}=\sqrt{\mu_{eff}\in_{eff}}$, where $n_{eff}$ is the effective refractive index, $\mu_{eff}$ is the effective permeability, and $\in_{eff}$ is the effective permittivity. By controlling the layout of the I-shaped inductor members 263 and 264 and the C-shaped members 261 and 262, $\mu_{eff}$ and $\in_{eff}$ can be modulated so as to obtain an effective fractional index $n_{eff}$ between 0 and 1. Accordingly, the radiation of the antenna can be concentrated along a particular direction, i.e., the gain of the antenna can be increased.

Preferably, the permittivity of the dielectric substrate 121 and dielectric device 114 is between 1 and 100 farad/meter, and the permeability of the dielectric substrate 121 and dielectric device 114 is between 1 and 100 Wb/ampere-meter.

FIGS. 6(*a*) through 6(*e*) show other embodiments of the second fractal inductor layout 16. As shown in FIGS. 6(*a*) and 6(*b*), the C-shaped inductor members 261 and 262 are replaced with ring inductor members 271 and square ring inductor members 273, respectively. In FIG. 6(*c*), the inductor lines connected to ends of I-shaped members are removed, and C-shaped inductor members 275 and 276 are further added in the other two quadrants separate from the I-shaped inductor members 263 and 264. Alternatively, the C-shaped inductor members can be replaced with square ring inductor members 273 or ring inductor members 271 as shown in FIGS. 6(*d*) and 6(*e*), respectively.

In accordance with the present invention, a single antenna radome element is designed first, and then the antenna radome elements are associated together to form an antenna radome. The antenna radome is associated with an antenna to form an antenna apparatus with high gain.

Figure 7:
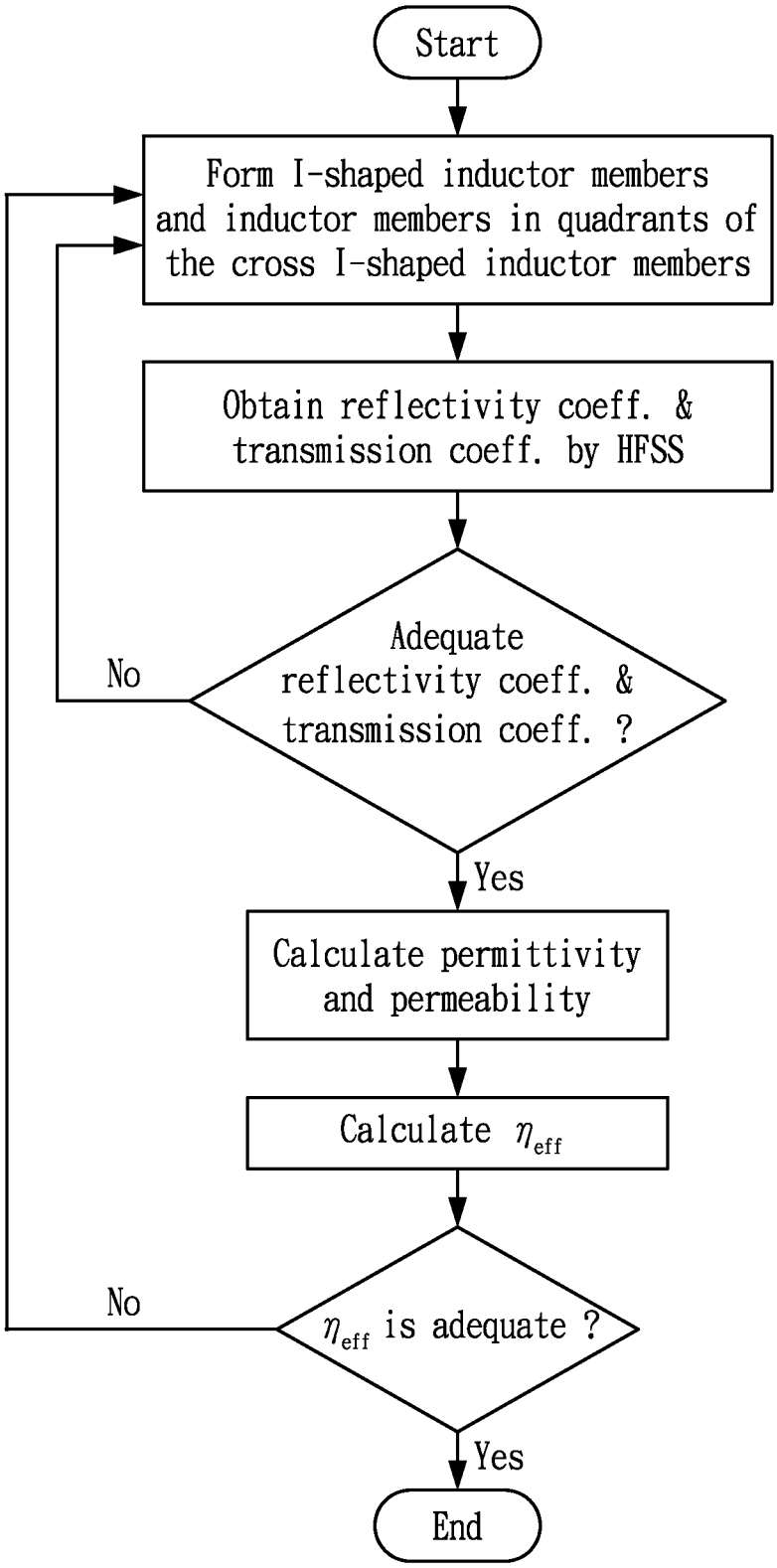
FIG. 7 shows a design flow for the radome element of the present invention.

FIG. 7 shows a design flow chart for a single antenna radome element. First, cross I-shaped inductor members and inductor members in the quadrants of the cross I-shaped inductor members are adjusted to approach a resonance length (approximately ¼ wavelength). Because the effective permittivity and effective permeability cannot be acquired directly, the reflectivity coefficient and transmission coefficient are obtained first by High Frequency Simulator Software (HFSS). If the reflectivity coefficient and transmission coefficient are adequate, the permittivity and permeability are calculated based on the reflectivity coefficient and transmission coefficient, and the effective refractive index can be calculated by mathematical computation software e.g., Matlab. If the effective refractive index is adequate, e.g., $0<n_{eff}<1$, the design is determined to be acceptable.

Figure 8:
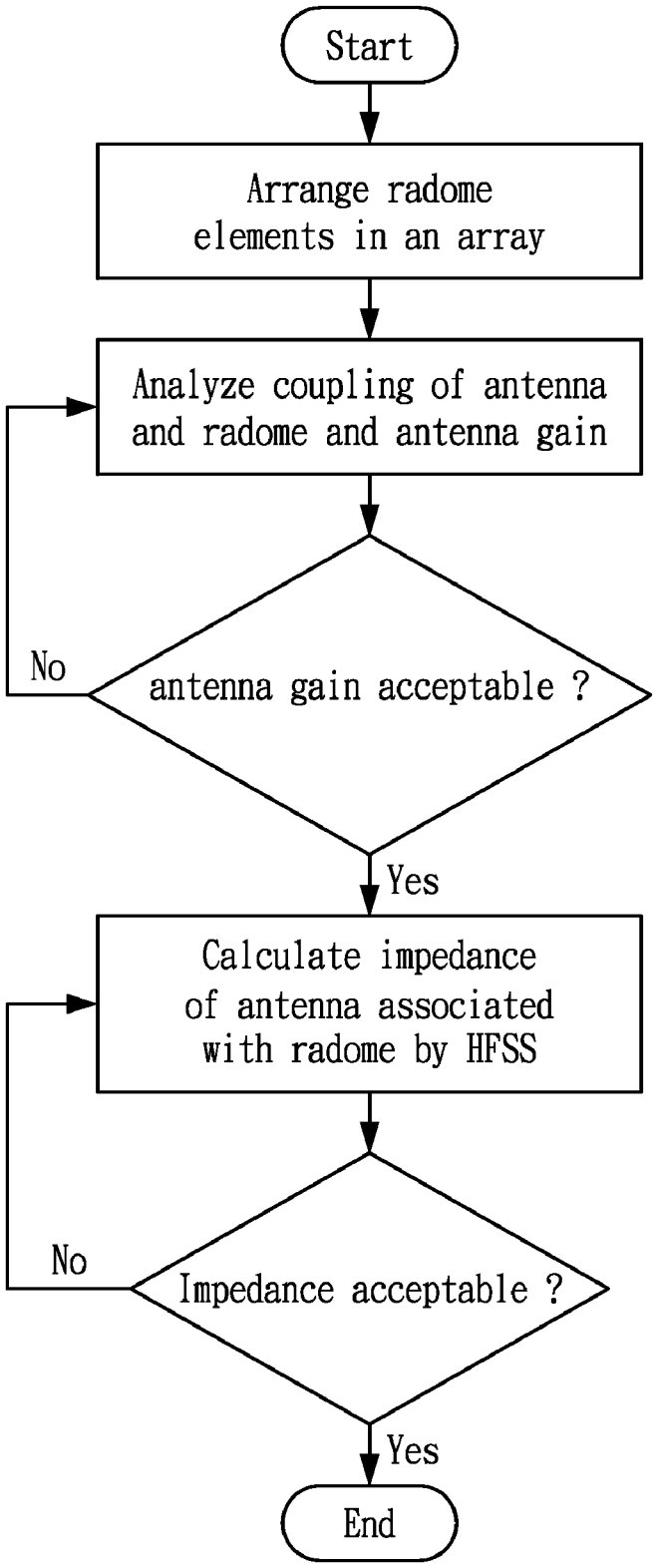
FIG. 8 shows a design flow for the integration of the radome element and an antenna.

FIG. 8 shows a design flow chart for integration of the antenna radome and the antenna. First, a plurality of the radome elements are arranged in at least a 2×2 array, e.g., a 3×3 array, to form an antenna radome. Next, the antenna radome is combined with the antenna. The coupling of the antenna radome and the antenna and the gain difference of the antenna are computed by HFSS. If the gain meets the requirement, the impedance of the antenna coupled with the antenna radome is calculated. If the impedance is acceptable, the design of the antenna apparatus is accepted.

Figure 9:
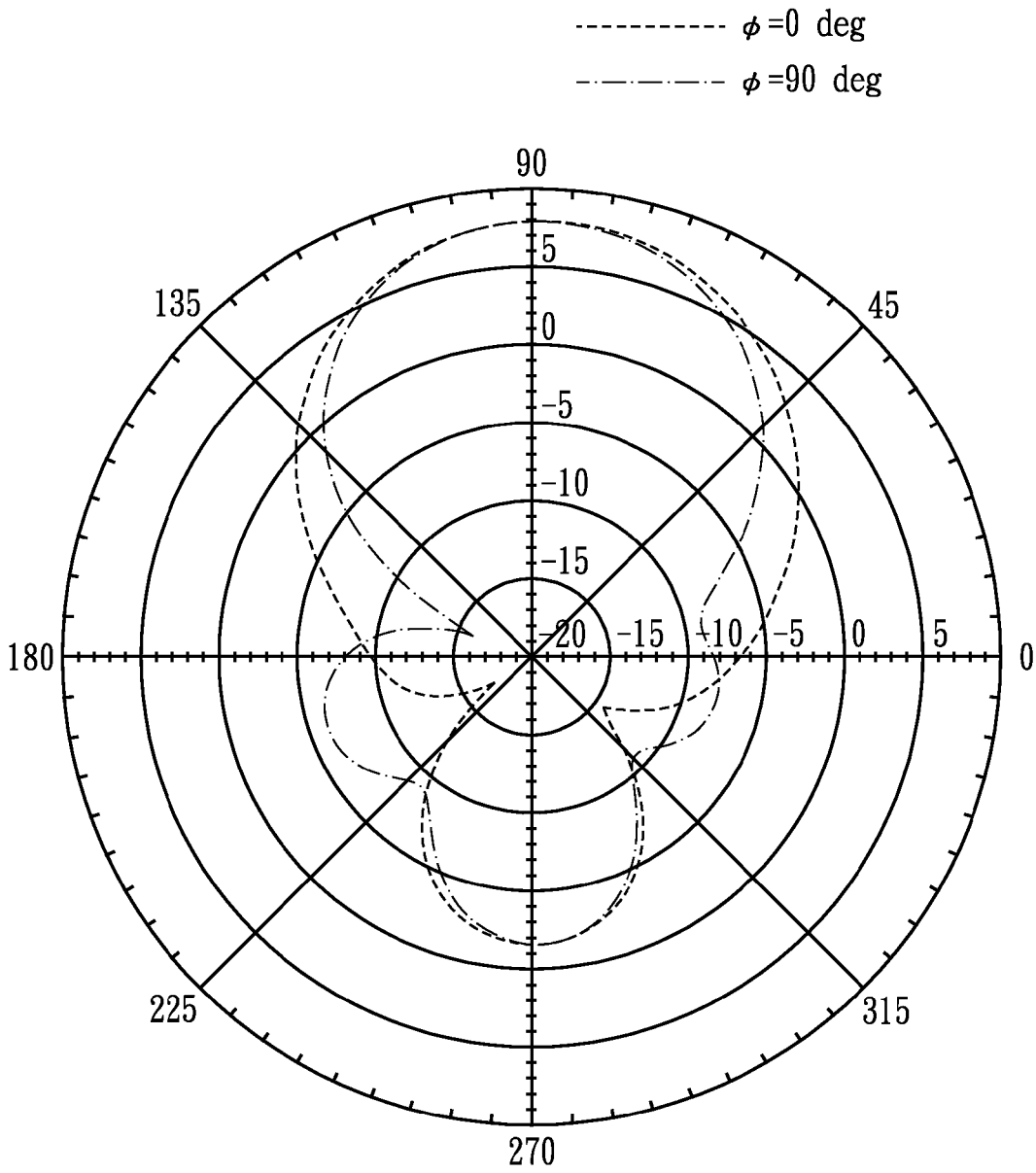
FIG. 9 shows a radiation pattern of the antenna apparatus in accordance with the present invention.

FIG. 9 shows the radiation pattern of the antenna apparatus of the embodiment of the present invention. It indicates that the antenna apparatus has a radiation pattern with high directionality.

Figure 10:
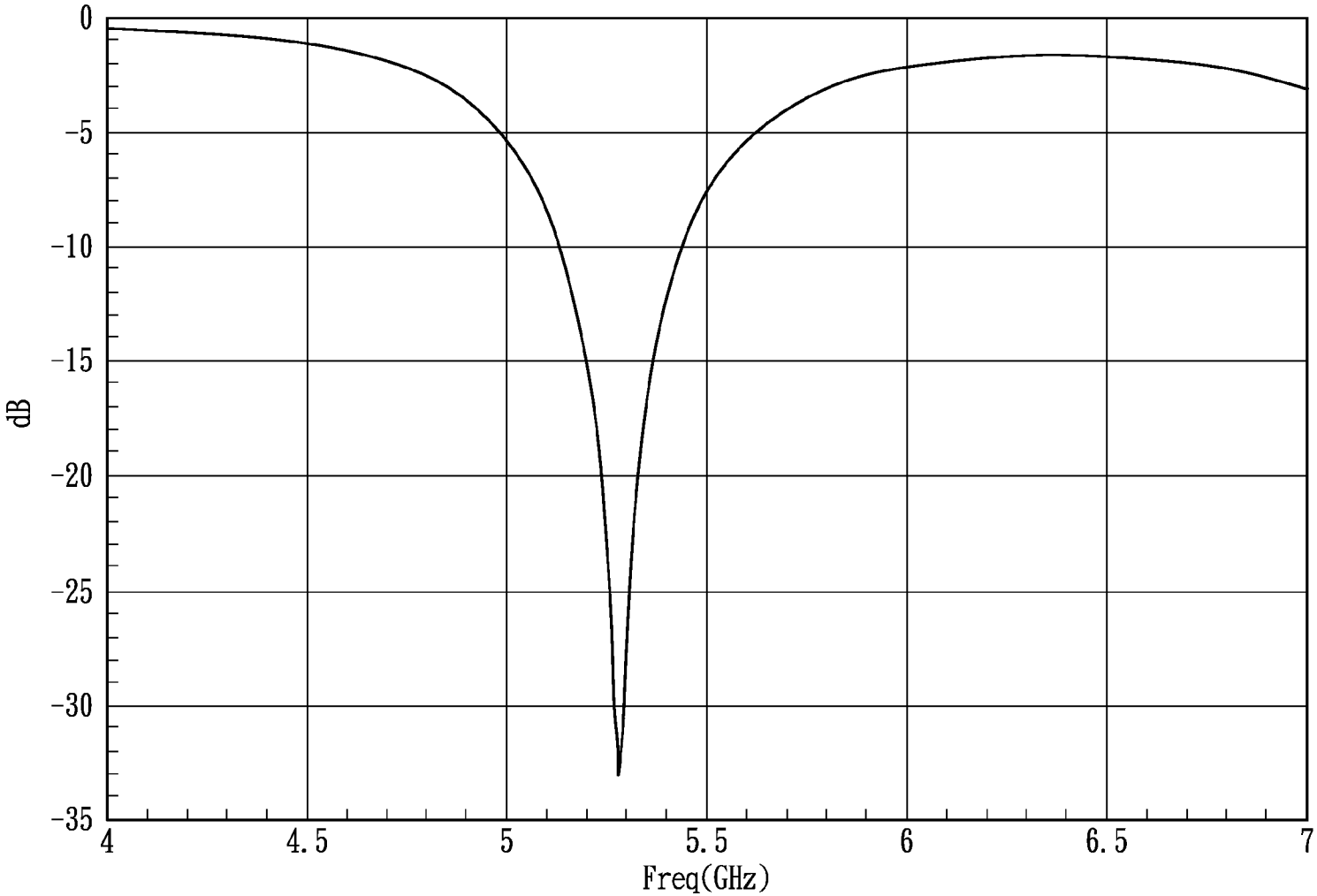
FIG. 10 shows return loss of the antenna apparatus in accordance with the present invention.

FIG. 10 shows return loss of the present invention. It indicates that return loss is low for frequencies within the range of 5.15-5.35 GHz. Therefore, the antenna apparatus performs well within the desired frequency range of 5.15-5.35 GHz.

The above-described embodiments of the present invention are intended to be illustrative only. Numerous alternative embodiments may be devised by those skilled in the art without departing from the scope of the following claims.

What is claimed is:

1. An antenna radome associated with an antenna and comprising a plurality of radome elements, each radome element comprising:

a dielectric substrate on which an upper surface is provided with a first fractal inductor layout and a lower surface is provided with a second fractal inductor layout, the second fractal inductor layout comprising a first inductor and a second inductor;

wherein the first inductor and second inductor are associated to accumulate charges so as to increase radiation directionality of the antenna.

2. The antenna radome in accordance with claim 1, wherein the plurality of radome elements are arranged in an array.

3. The antenna radome in accordance with claim 1, wherein the first inductor and second inductor are printed inductors.

4. The antenna radome in accordance with claim 1, wherein the first inductor is X-shaped, and the second inductor comprises a first inductor member and a second inductor member disposed in two corresponding quadrants separated by the X-shaped first inductor.

5. The antenna radome in accordance with claim 4, wherein the X-shaped first inductor is constituted of two intersecting I-shaped inductor members.

6. The antenna radome in accordance with claim 5, wherein the two I-shaped inductor members are intersecting with angles between 45 and 90 degrees.

7. The antenna radome in accordance with claim 5, wherein the X-shaped first inductor further comprises four inductor lines each being connected to an end of the I-shaped inductor member.

8. The antenna radome in accordance with claim 7, wherein the inductor line is connected to the end of the I-shaped inductor member at an angle between 15 and 90 degrees.

9. The antenna radome in accordance with claim 7, wherein the four inductor lines are formed in two quadrants of the X-shaped first inductor without the second inductor.

10. The antenna radome in accordance with claim 5, wherein the first inductor member and the second inductor member are C-shaped.

11. The antenna radome in accordance with claim 10, wherein openings of the C-shaped first and second inductor members substantially face an intersection of the two I-shaped inductor members.

12. The antenna radome in accordance with claim 10, wherein directions of openings of the C-shaped first and second inductor members are substantially parallel to electric field of the antenna.

13. The antenna radome in accordance with claim 4, wherein the first inductor member and the second inductor member are in the form of rings.

14. The antenna radome in accordance with claim 4, wherein the first inductor member and the second inductor member are in the form of rectangular rings.

15. The antenna radome in accordance with claim 1, wherein the first inductor is X-shaped, and the second inductor comprises four inductor members disposed in four quadrants separated by the X-shaped first inductor.

16. The antenna radome in accordance with claim 15, wherein the X-shaped first inductor is constituted of two intersecting I-shaped inductor members.

17. The antenna radome in accordance with claim 16, wherein the two I-shaped inductor members are intersecting with angles between 45 and 90 degrees.

18. The antenna radome in accordance with claim 16, wherein the four inductor members are C-shaped, and openings of the C-shaped inductor members face the intersection of the two I-shaped inductor members.

19. The antenna radome in accordance with claim 15, wherein the four inductor members are in the form of rings.

20. The antenna radome in accordance with claim 15, wherein the four inductor members are in the form of rectangular rings.

21. The antenna radome in accordance with claim 1, wherein the first fractal inductor layout comprises a plurality of rectangle inductor groups.

22. The antenna radome in accordance with claim 1, wherein the first fractal inductor layout comprises a left rectangle inductor group, a middle rectangle inductor group and a right rectangle inductor group.

23. The antenna radome in accordance with claim 22, wherein the left rectangle inductor group has equivalent length and width.

24. The antenna radome in accordance with claim 22, wherein the middle rectangle inductor group has equivalent length and width.

25. The antenna radome in accordance with claim 22, wherein the right rectangle inductor group has equivalent length and width.

26. The antenna radome in accordance with claim 22, wherein the left rectangle inductor group comprises a plurality of rectangle inductors.

27. The antenna radome in accordance with claim 22, wherein the middle rectangle inductor group comprises a plurality of rectangle inductors.

28. The antenna radome in accordance with claim 22, wherein the right rectangle inductor group comprises a plurality of rectangle inductors.

29. The antenna radome in accordance with claim 1, wherein the dielectric substrate has a permittivity between 1 and 100 farad/meter.

30. The antenna radome in accordance with claim 1, wherein the dielectric substrate has a permeability between 1 and 100 Wb/ampere-meter.

31. The antenna radome in accordance with claim 1, wherein the plurality of radome elements are arranged in a square array.

32. The antenna radome in accordance with claim 1, wherein the plurality of radome elements are arranged in a 3×3 array.

33. The antenna radome in accordance with claim 1, wherein the antenna is a patch antenna.

34. The antenna radome in accordance with claim 1, wherein the antenna radome is at a distance less than half-wavelength of a transmission signal from the antenna.

35. The antenna radome in accordance with claim 1, wherein the first fractal inductor layout is configured to decrease frequency of the antenna.

36. The antenna radome in accordance with claim 1, wherein the second fractal inductor layout is modulated to adjust effective permittivity and effective permeability of the dielectric substrate.

37. An antenna apparatus, comprising:

an antenna; and an antenna radome associated with the antenna and comprising a plurality of radome elements, each radome element comprising a dielectric substrate on which an upper surface is provided with a first fractal inductor layout and a lower surface is provided with a second fractal inductor layout, wherein the second fractal inductor layout comprises a first inductor and a second inductor; the first inductor and second inductor are associated to accumulate charges so as to increase radiation directionality of the antenna.

38. The antenna apparatus in accordance with claim 37, wherein the first inductor is X-shaped, and the second inductor comprises a first inductor member and a second inductor member disposed in two corresponding quadrants separated by the X-shaped first inductor.

39. The antenna apparatus in accordance with claim 38, wherein the X-shaped first inductor is constituted of two intersecting I-shaped inductor members.

40. The antenna apparatus in accordance with claim 39, wherein the first inductor member and the second inductor member are C-shaped.

41. The antenna apparatus in accordance with claim 40, wherein openings of the C-shaped first and second inductor members substantially face the intersection of the two I-shaped inductor members.

42. The antenna apparatus in accordance with claim 40, wherein directions of openings of the C-shaped first and second inductor members are substantially parallel to electric field of the antenna.

43. A design method for an antenna radome associated with an antenna, comprising:

providing a dielectric substrate; and forming fractal inductor layouts on upper and lower surfaces of the dielectric substrate to adjust permittivity and permeability of the antenna, so as to obtain an effective refraction index between 0 and 1.

44. The design method in accordance with claim 43, wherein the permittivity and permeability are calculated based on reflectivity coefficient and transmission coefficient.

45. The design method in accordance with claim 44, wherein the reflectivity coefficient and transmission coefficient are obtained by high frequency stimulation software.

46. The design method in accordance with claim 43, wherein the step of forming fractal inductor layouts on upper and lower surfaces of the dielectric substrate forms the antenna radome including a plurality of the radome elements.

47. The design method in accordance with claim 46, wherein the plurality of the radome elements are arranged in an array.

* * * * *